US008651759B2

(12) United States Patent
Takahashi et al.

(10) Patent No.: US 8,651,759 B2
(45) Date of Patent: Feb. 18, 2014

(54) CYLINDRICAL COSMETIC CONTAINER

(75) Inventors: Kazuo Takahashi, Yokohama (JP); Takahiro Kusumoto, Yokohama (JP); Kenichi Hiyama, Tokyo (JP); Yoshinobu Abe, Tokyo (JP); Yutaka Mihara, Tokyo (JP)

(73) Assignee: Hidan Co., Ltd. (JP)

( * ) Notice: Subject to any disclaimer, the term of this patent is extended or adjusted under 35 U.S.C. 154(b) by 960 days.

(21) Appl. No.: 12/423,179

(22) Filed: Apr. 14, 2009

(65) Prior Publication Data

US 2010/0258466 A1 Oct. 14, 2010

(51) Int. Cl.
*B43K 21/08* (2006.01)
*B43K 21/00* (2006.01)

(52) U.S. Cl.
USPC ..... 401/78; 206/385; 401/80

(58) Field of Classification Search
USPC ..... 401/88, 49, 59, 98, 78, 80; 206/385
See application file for complete search history.

(56) References Cited

U.S. PATENT DOCUMENTS 4,603,989 A * 8/1986 Ackerman et al. ..... 401/78
4,792,251 A * 12/1988 Ryder ..... 401/74
5,873,667 A * 2/1999 Inoue et al. ..... 401/78
6,070,725 A * 6/2000 Ito et al. ..... 206/385
6,343,886 B2 * 2/2002 Shochat ..... 401/87
6,623,199 B2 * 9/2003 Naramoto et al. ..... 401/98
6,827,213 B2 * 12/2004 Hirotomi et al. ..... 206/385
6,902,333 B2 * 6/2005 Miyagawa et al. ..... 401/66
7,553,101 B2 * 6/2009 Harano et al. ..... 401/98

FOREIGN PATENT DOCUMENTS

JP 2000-004932 1/2000

* cited by examiner

*Primary Examiner* — David J. Walczak
*Assistant Examiner* — Jennifer C Chiang
(74) *Attorney, Agent, or Firm* — Gerald E. Hespos; Michael J. Porco; Matthew T. Hespos

(57) ABSTRACT

A cylindrical cosmetic container with an inner cap (7) inside a cap (5) fit outside an upper end of a container body (X) uses a first motion resistance at a halfway covering posture to an immediately preceding covering posture and a second motion resistance from the immediately preceding covering posture to a fully cover posture while the container body (X) is covered with the cap (5), in which the inner cap (7) includes a protrusion (7*f*) to deform towards an outer diameter side while applying the first motion resistance by being pressed into sliding contact with an extending upper end (4*c*) of the container body (X) and a projection (7*d*) projecting from an outer circumferential surface for applying the second motion resistance greater than the first motion resistance when a convex rib (4*b*) moves over the projection (7*d*).

9 Claims, 5 Drawing Sheets

CYLINDRICAL COSMETIC CONTAINER

BACKGROUND OF THE INVENTION

1. Field of the Invention

This disclosure relates to a cylindrical cosmetic container for storing a cylindrical (stick-shaped) cosmetic such as lipstick.

2. Description of the Related Art

JP-B-3153992 discloses a cylindrical cosmetic container that has a thick-walled portion formed on an inner cap of a cap and a convex rib formed on an upper end of a container body. A motion resistance occurs while the convex rib moves over the thick-walled portion in a state in which the container body is being covered fully with the cap (hereinafter referred to as an immediately preceding covering posture) to a state in which the container body is covered fully with the cap (hereinafter referred to as a fully covering posture). The motion resistance can be interpreted as indicating a completely covered condition.

In the above-mentioned conventional container, however, the inner cap is fit loosely outside an upper end member of the cap with a space therebetween prior to the immediately preceding covering posture while the container body is covered with the cap. As a result, the cap covering is unstable until the container body is covered completely with the cap. This sense of instability ruins an upscale nature that the cosmetic container is required to possess.

The present invention was made in view of the foregoing actual circumstances to solve at least the above-mentioned problems.

SUMMARY OF THE INVENTION

The invention is a cylindrical cosmetic container configured to incorporate an inner cap inside a cap that is fit outside an upper end member of a container body where a cylindrical cosmetic is stored and covers the container body. A convex rib projects from an outer circumferential surface of the upper end member of the container body and an extending end portion of the upper end member extends farther up than the convex rib. The inner cap is formed with at least one inward protrusion that protrudes from an inner circumferential surface. The inward protrusion is configured to be pressed into sliding contact with the extending end portion and deforms to an outer diameter side for applying a first motion resistance from a halfway covering posture through an immediately preceding covering posture to a fully covering posture in the course of covering with the cap. The inner cap also has an outward protrusion that protrudes from an outer circumferential surface. The convex rib cooperates with the outward protrusion to apply a second motion resistance that is larger than the first motion resistance from the immediately preceding covering posture to the full cover in the course of covering with the cap.

The first motion resistance is produced at a preliminary step prior to the successive steps of the immediately preceding covering posture and the fully covering posture. The second motion resistance is greater than the first motion resistance and is produced at a final step of the covering operation. As a result, the cap covering operation acquires an increased stability while an upscale appearance is maintained.

The at least one inward protrusion formed on the inner cap preferably comprises a plurality of vertically long linear protrusions that are circumferentially spaced. Accordingly, the first motion resistance is applied uniformly in the circumferential direction for a longer time. As a result, the stability is further increased.

The at least one inward protrusion on the inner cap may define a V-shape or U-shape in horizontal section and may project toward an inner circumferential surface side. Additionally, the at least one inward protrusion formed on the inner cap may be sunk at an outer circumferential surface side and preferably is vertically long. The extending end portion preferably deforms the inward protrusion toward the outer diameter side to produce the first resistance. The moderate deformation of the inner cap produces the first motion resistance. As a result, the stability is increased even further.

DETAILED DESCRIPTION OF THE PREFERRED EMBODIMENT

Figure 1:
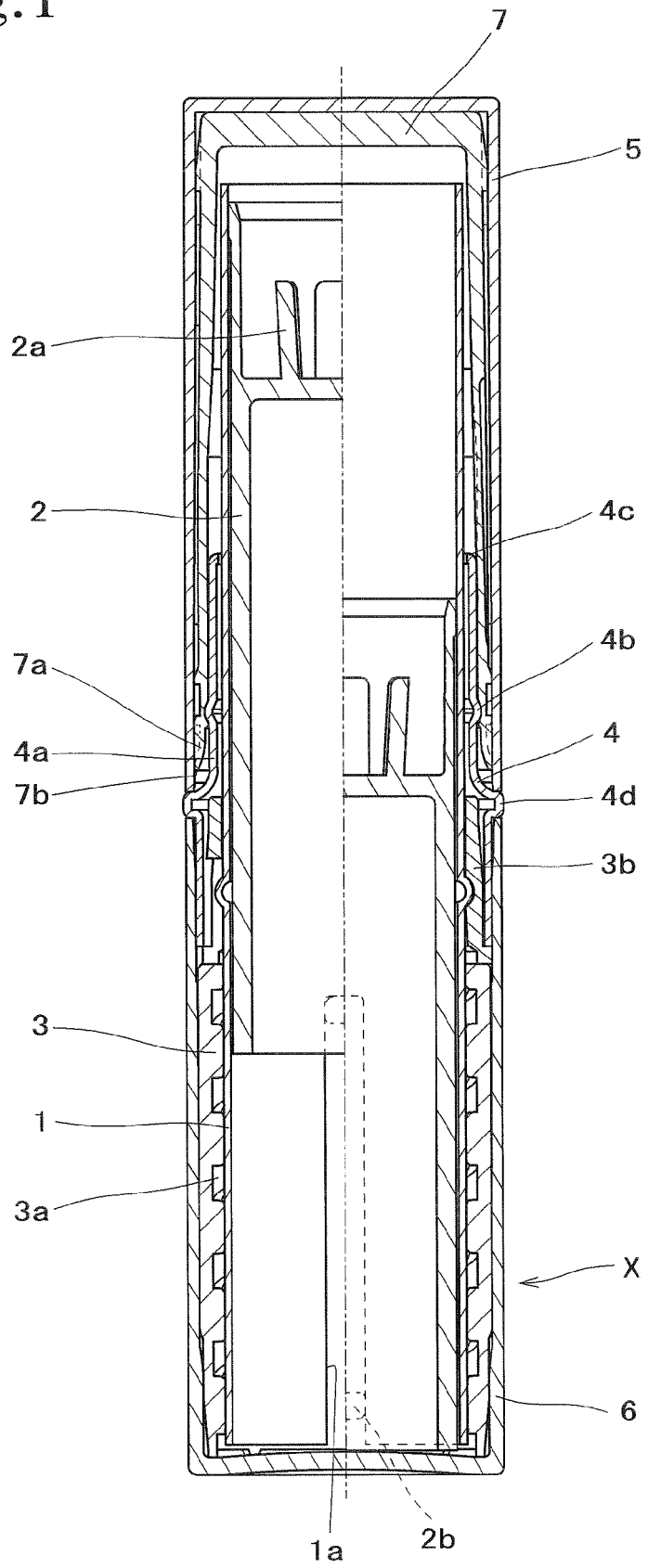
FIG. 1 is a longitudinal sectional view showing a state where a middle tool of a cosmetic container covered with a cap moves to a bottom end position and a top end position.

A cylindrical cosmetic container in accordance with an embodiment of the invention includes a cylinder main body identified generally by the numeral 1 in FIG. 1. The cylinder main body 1 comprises a guide hole la that extends along a longitudinal (vertical) direction. A middle plate body 2 is incorporated in the cylinder main body 1 so as to be movable up and down. An accommodating portion 2*a* is formed in an upper part of the middle plate body 2 for accommodating a cylindrical cosmetic (not illustrated).

A spiral cylinder body 3 incorporates the cylinder main body 1 and a spiral groove 3*a* is formed on an inner circumferential surface of the spiral cylinder body 3. An engagement protrusion 2*b* protrudes from an outer circumferential surface of the middle plate body 2. The engagement protrusion 2*b* penetrates through the guide hole la and engages the spiral groove 3*a* to be movable vertically. Rotation of the spiral cylindrical body 3 relative to the cylinder main body 1 causes the middle plate body 2 to move vertically without rotation relative to the cylinder main body 1.

A ring 3*b* is fit and fixed outside the cylinder main body 1 and is positioned at an upper end of the spiral cylinder body 3. A middle tool 4 has a lower end portion that is fit and fixed outside a lower end portion of the ring 3*b* and an upper end portion 4*a* that extends farther up than the upper end of the spiral cylinder body 3. The upper end portion 4*a* of the middle tool 4 is fit inside a lower end portion of a cap 5, which is described later. An annular convex rib 4*b* is formed on an outer circumferential surface of the upper end portion 4*a*, and the upper end portion 4*a* extends farther up from the convex rib 4*b*. The cylinder main body 1 projects up from an extending upper end 4*c* and is stepped in a smaller diameter. The extending upper end 4*c* of the middle tool 4 is bent inward in this embodiment, but may be straight without being bent. A petticoat cylinder body 6 is fit and fixed outside the middle tool 4 and spiral cylinder body 3. The components 1, 2, 3, 4, and 6 constitute a container body X.

A resinous tubular-topped inner cap 7 is fit and fixed inside the cap 5 so as not to come off. A space S exists between an outer circumferential surface of the inner cap 7 and an inner circumferential surface of the cap 5. The inner cap 7 has an open lower portion 7*a* that defines a trumpet-shape with an inner circumferential surface that flares gradually out toward a lower end, so that the extending upper end 4*c* of the middle tool 4 can be fit easily inside the inner cap 7. A lower end 7*b* of the opened lower portion 7*a* abuts against the inner circumferential surface of the lower end portion of the cap 5.

Figure 3D:
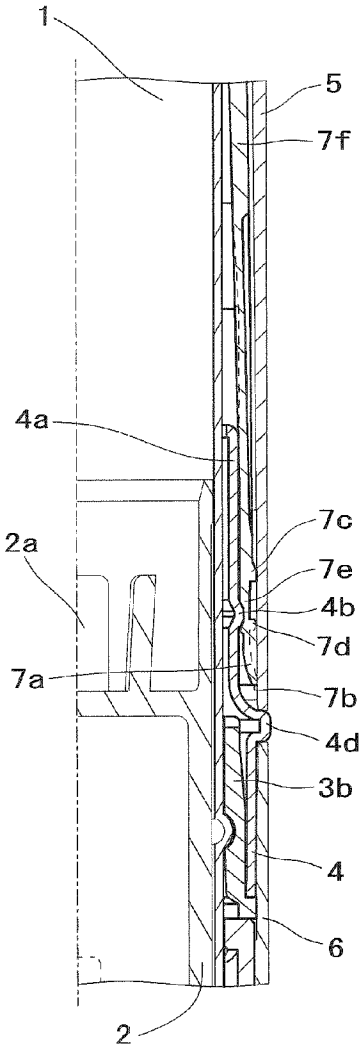
FIGS. 3A to 3D are enlarged longitudinal sectional views of a main part showing a course of a cap covering.
Figure 3C:
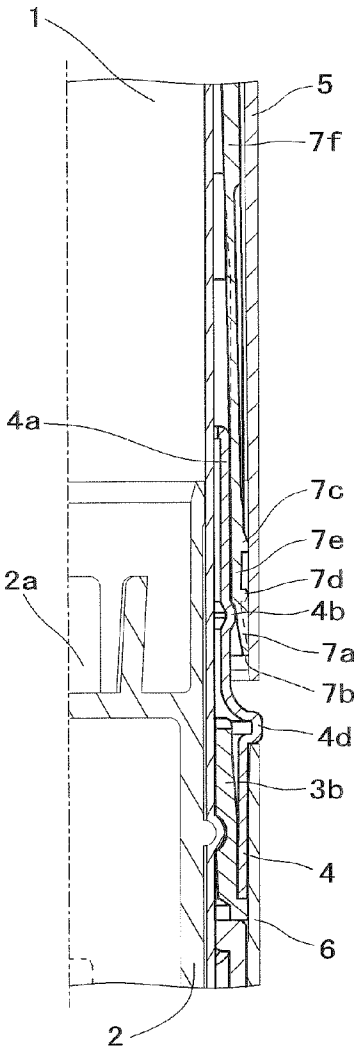
Figure 3B:
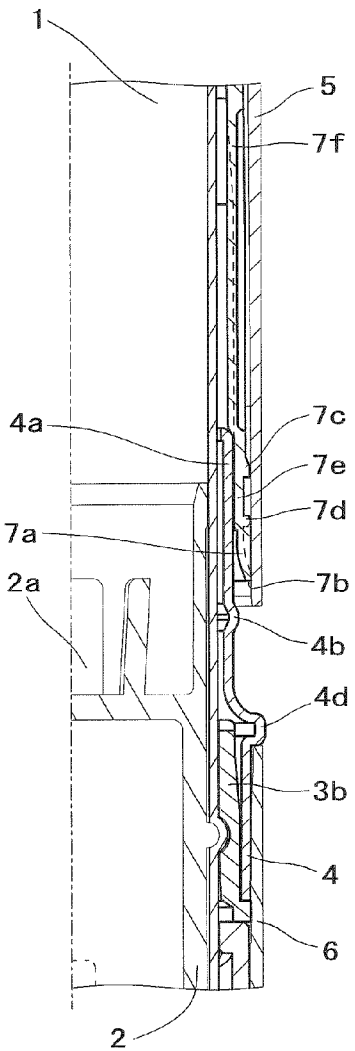
Figure 3A:
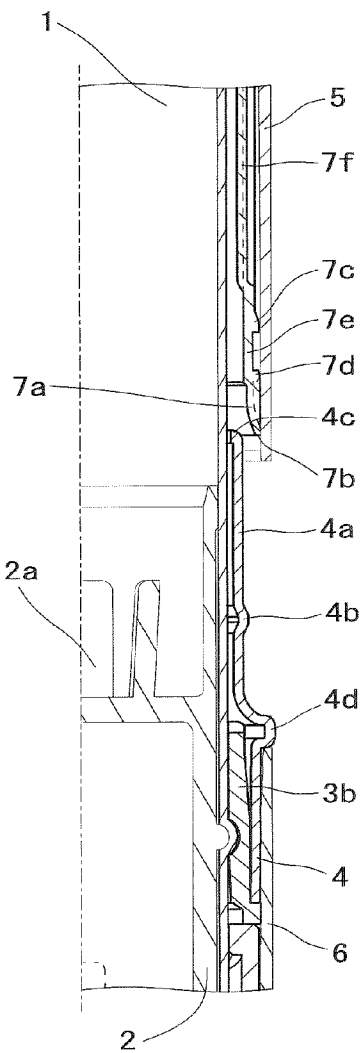
Figure 4A:
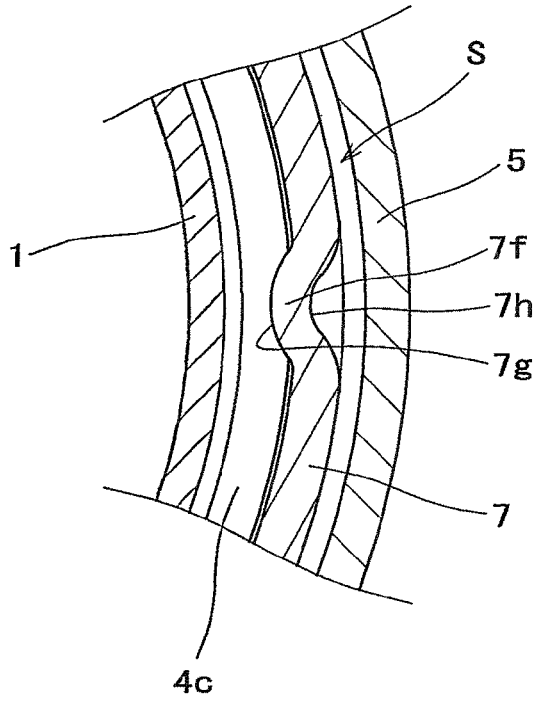
FIGS. 4A and 4B are enlarged horizontal sectional views of the main part respectively showing a state without a first motion resistance and a state with a first motion resistance in the course of the cap covering.
Figure 4B:
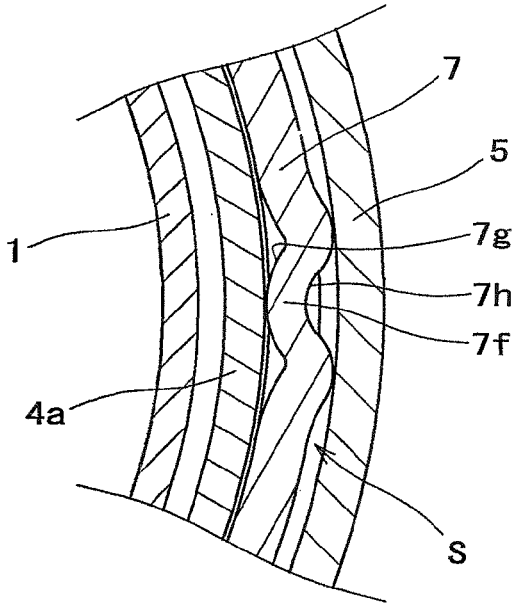
Figure 5A:
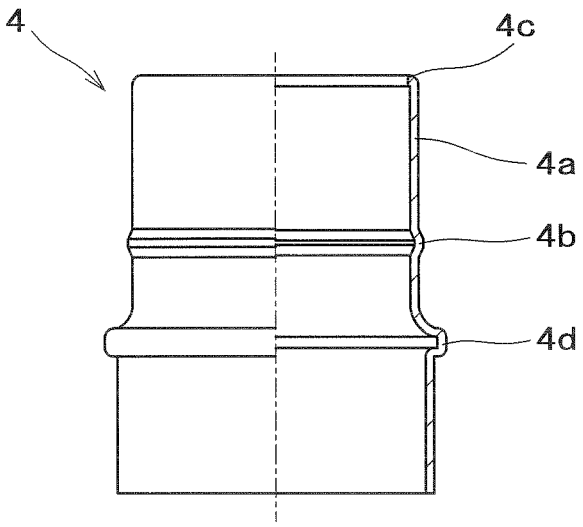
FIG. 5A is a partial sectional front view of the middle tool.
Figure 5B:
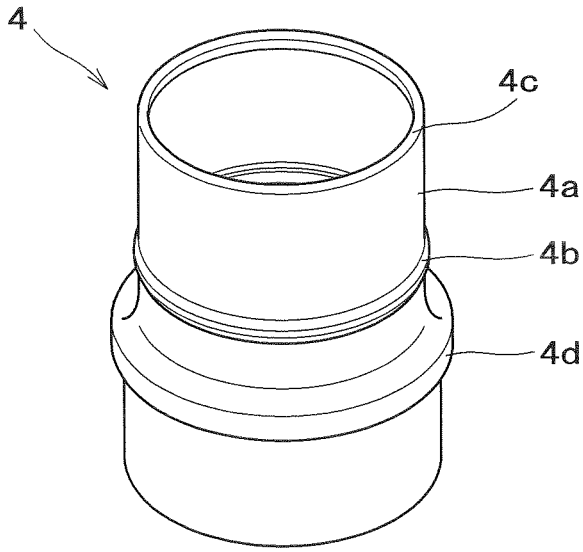
FIG. 5B is a perspective view of the middle tool.

First and second thick-walled projections 7*c* and 7*d* are formed on an outer circumferential surface of the inner cap lower end portion 7*a* and are shaped annularly. The first and second thick-walled projections 7*c* and 7*d* are spaced vertically from each other and abut against the inner circumferential surface of the cap 5. A thin portion 7*e* is defined between the first and second projections 7*c* and 7*d* at a position spaced from the cap 5 and is thinner than the projections 7*c* and 7*d*. During a covering (closing) of the cap 5, the convex rib 4*b* of the middle tool 4 is positioned at a lower side of the second projection 7*d* at an immediately preceding covering posture (see FIG. 3C), and a motion resistance is applied. This motion resistance defines a second motion resistance in the present invention. The cap 5 then is pushed forcibly further to obtain a fully covering posture (see FIG. 3D). The convex rib 4*b* moves over the second projection 7*d* and into a position between the first and second projections 7*c* and 7*d* in this fully covering posture. This causes the thinner portion 7*e* to deform elastically towards an outer diameter side. This elastic force presses the first and second projections 7*c* and 7*d* against the inner circumferential surface of the cap 5. As a result, double air tightness is achieved. A lower end 5*a* of the cap 5 abuts with impact against an annular protrusion 4*d* on the middle tool 4 when the fully covering posture is achieved in this way. Thus, a snapping sound is produced to provide a tactile and auditory confirmation that the cap 5 is brought into the fully covering posture.

The invention can be carried out without providing the above-mentioned superior air tightness. In addition, the middle tool 4 may be formed without the annular protrusion 4*d* so that the cap lower end 5*a* abuts against an upper end 6*a* of the petticoat cylinder body 6 to produce a snapping sound upon reaching the fully covering posture.

Protrusions 7*f* are formed circumferentially on an inner circumferential surface of the inner cap 7 (see FIGS. 3A-3D, 4A, and 4B). Another motion resistance is applied when the extending upper end 4*c* of the middle tool 4 abuts against the protrusions 7*f* at a halfway covering posture prior to the immediately preceding covering posture in which the convex rib 4*b* reaches the lower side second projection 7*d* so that the second motion resistance is applied. The motion resistance applied at the halfway covering posture defines a first motion resistance.

Figure 2A:
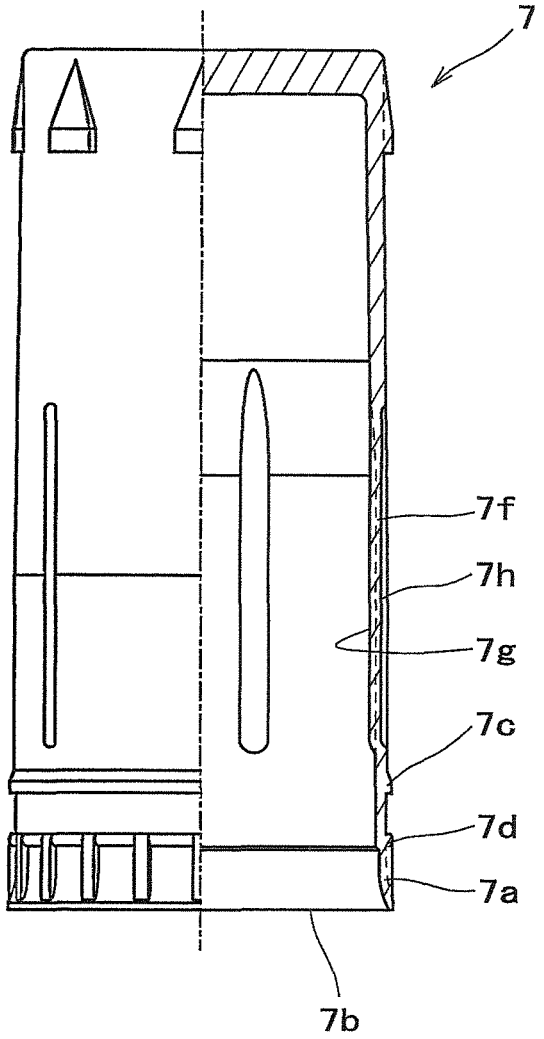
FIG. 2A is a front view and FIG. 2B is a plan view of a partial longitudinal section of an inner cap, respectively.
Figure 2B:
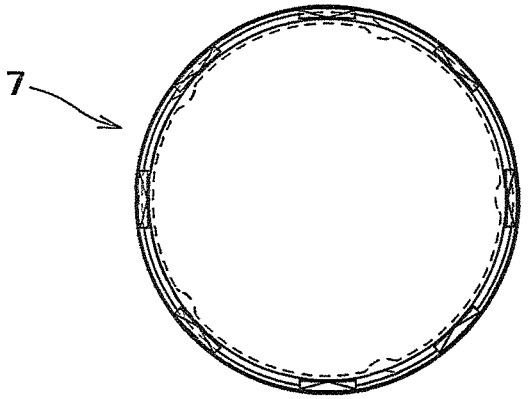

Each protrusion 7*f* protrudes towards the inner circumferential surface side of the inner cap 7 (shown as convex side 7*g* in FIGS. 2A, 4A, and 4B) and also sinks on the outer circumferential surface side of the inner cap 7. (shown as concave side 7*h* in FIGS. 2A, 4A, and 4B) More particularly, each protrusion 7*f* is laterally and cross-sectionally a vertically long U-shaped channel (bowl shape). A horizontal sectional U-shape is not necessary for the protrusion 7*f* provided that the protrusion 7*f* produces a first motion resistance. For example, the protrusion 7*f* can be a horizontal sectional V-shape. The protrusion 7*f* also can be thick-walled and can project in from the inner circumferential surface.

The first motion resistance is applied, as the extending upper end 4*c* of the middle tool 4 abuts against the inner cap protrusion 7*f* (see FIGS. 3B and 4A) from a motion resistance free state where the middle tool 4 does not interfere with the inner cap 7 (see FIG. 3A) during the covering operation of the cap 5. Thrusting the cap 5 against the first motion resistance causes the protrusion 7*f* to deform elastically toward the outer diameter side within the space (see FIGS. 3C and 4B). Thus, the covering operation is performed while the first motion resistance is maintained.

The second motion resistance is applied, as the convex rib 4*b* reaches the second projection 7*d*. Note that the first motion resistance is applied with an elastic deformation of the protrusion 7*f* within the space S, whereas the second motion resistance is applied by forcibly moving over the second projection 7*d* that abuts against the inner circumferential surface of the cap 5. In other words, the second motion resistance is larger than the first motion resistance. Accordingly, the covering operation of the cap 5 comprises the successive steps of: applying the smaller first motion resistance continuously; applying the larger second motion resistance instantaneously; and producing an agreeable snapping sound when the covering operation is completed.

The container body X is covered with the cap 5 and the inner cap 7 is fit inside the cap 5. The second projection 7*d* is formed at the lower end portion of the inner cap 7. A snapping sound is produced under the larger second motion resistance when the convex rib 4*b* forcibly moves over the second projection 7*d* at the immediately preceding covering posture, and the fully covering posture is achieved. The small first motion resistance is applied when the extending upper end 4*c* of the middle tool 4 abuts against the inner cap protrusion 7*f* at the halfway covering posture prior to the immediately preceding covering posture followed by the fully covering posture. The first motion resistance continues up to the immediately preceding covering posture, and the full covering posture is achieved, with the second motion resistance is being applied.

There exists a first free state without a motion resistance prior to the halfway covering posture (see FIG. 3A) during the covering operation. The smaller first motion resistance is applied in midstream through the first free state. After that, the cap covering is finalized to cover the container body fully and producing a snapping sound under the second larger second motion resistance. As a result, the covering operation is stable and a required upscale appearance is achieved.

The plurality of protrusions 7*f* are arranged circumferentially at equal intervals on the inner cap 7 and hence provide an evenly distributed first motion resistance. Thus, a further increased stability and an excellent cap covering operation are achieved.

Further, each protrusion 7*f* that provides the first motion resistance is vertically long and U-shaped in horizontal section. Each protrusion 7*f* projects toward the inner circumferential side relative to the inner cap 7 and also sinks on the outer circumferential side. The protrusions 7*f* are thrust by the extending upper end 4*c* of the middle tool 4 so as to deform elastically out within the space S while the first motion resistance is applied in the course of covering operation. As a result, the resistance is moderate, and the stability is enhanced further.

It should be understood, that the invention is not restricted to the cylindrical cosmetic container of the aforementioned embodiment. Rather, the invention also can be applied to a variety of cylindrical cosmetic containers within the practicable scope of the present invention as defined by the claims.

What is claimed is:

1. A cosmetic container comprising:

a cylindrical container body including:

a cylinder main body, a spiral cylinder body having upper and lower ends and incorporating the cylinder main body so as to rotate relative to the cylinder main body, a middle plate body configured for accommodating a cylindrical cosmetic, the middle plate body being movable up and down corresponding to the relative rotation of the cylinder main body and the spiral cylinder body, a middle tool having opposite upper and lower ends and an outer circumferential surface extending between the ends, the upper end of the middle tool extending farther up than the upper end of the spiral cylinder body, a convex rib protruding out from the outer circumferential surface of the middle tool at a position between the upper end of the middle tool and the upper end of the spiral cylinder body; and a cap assembly fit outside the upper end of the cylinder main body for covering the upper end of the middle tool above the upper end of the spiral cylinder body, the cap assembly including:

an outer cap, and an inner cap incorporated into the outer cap, the inner cap having at least one protrusion protruding from an inner circumferential surface of the inner cap and being deformable outwardly in response to contact with the upper end of the middle tool for applying a first motion resistance from a halfway covering posture to an immediately preceding covering posture in the course of covering the container body with the cap assembly, at least one projection projecting from an outer circumferential surface of the inner cap at a position lower than the protrusion, and portions of the inner circumferential surface of the inner cap aligned with the projection moving together over the convex rib for applying a second motion resistance larger than the first motion resistance while the projection moves past the convex rib from the immediately preceding covering posture to a fully covering posture in the course of covering the container body with the cap assembly, and the second motion resistance is applied while the first motion resistance is maintained.

2. The cosmetic container of claim 1, wherein the at least one protrusion is long, substantially linear and substantially parallel to an axis extending between the opposite upper and lower ends.

3. The cosmetic container of claim 2, wherein the at least one protrusion comprises a plurality of protrusions spaced circumferential from one another.

4. The cosmetic container of claim 2, wherein the protrusion has a convex side projecting in for contact with the upper end of the container body, the protrusion further having a concave side facing out toward the outer cap of the cap assembly.

5. The cosmetic container of claim 4, wherein the protrusion has a substantially V-shape or U-shape in a cross-section to the axis.

6. The cosmetic container of claim 2, wherein the protrusion is configured to deform towards the outer diameter side while applying the first resistance by being pressed into sliding contact with the extending upper end.

7. The cosmetic container of claim 2, wherein a space is defined between the inner and outer caps at locations aligned with the protrusion.

8. The cosmetic container of claim 1, wherein the container body has an annular protrusion between the convex rib and the lower end, the annular protrusion being disposed for audible contact with the cap assembly when the cap assembly reaches the fully covering posture.

9. The cosmetic container of claim 1, wherein portions of the inner cap adjacent to and above the projection are thinned.

* * * * *